United States Patent [19]

Braver

[11] 4,320,838

[45] Mar. 23, 1982

[54] CALCULATOR TRAY APPARATUS

[75] Inventor: Sanford L. Braver, Tempe, Ariz.

[73] Assignee: BCG, Ltd., Tempe, Ariz.

[21] Appl. No.: 110,130

[22] Filed: Jan. 7, 1980

[51] Int. Cl.[3] ..... B65D 1/34; G06C 5/02

[52] U.S. Cl. ..... 206/564; 235/1 R; 235/1 D

[58] Field of Search ..... 235/1 R, 1 D, 60.27, 235/4, 58 R, 61 A, 1 A-1 C, 1 E, 1 F; 206/559-565, 216; 364/708

[56] References Cited

U.S. PATENT DOCUMENTS

| | | | |
|---|---|---|---|
| 1,819,755 | 8/1937 | Primos | 235/1 R |
| 2,302,861 | 11/1942 | Hinkel | 206/559 |
| 2,841,899 | 7/1958 | Rengrow | 235/1 R |
| 3,103,303 | 9/1963 | Lynchey | 206/563 |
| 3,669,131 | 6/1972 | Parker | 206/561 |
| 3,674,132 | 7/1972 | Loss | 206/561 |
| 4,075,702 | 2/1978 | Davies | 364/708 |
| 4,083,453 | 4/1978 | Berger et al. | 206/564 |

*Primary Examiner*—L. T. Hix
*Assistant Examiner*—Benjamin R. Fuller
*Attorney, Agent, or Firm*—H. Gordon Shields

[57] ABSTRACT

Tray apparatus for use in business establishments includes a tray and a calculator for enabling patrons to verify and make arithmetic calculations.

6 Claims, 7 Drawing Figures

CALCULATOR TRAY APPARATUS

BACKGROUND OF THE INVENTION

1. Field of the Invention

This invention relates to trays, and, more particularly, to trays for customers of business or commercial establishments, such as for the presentation of bills and for payment of the bills.

2. Description of the Prior Art

It is rather common usage in various business or commercial establishments, such as food and beverage establishments, to present a bill or statement of charges on a tray to a customer. The customer responds to the presentation of the bill by placing on the tray the appropriate payment for the bill, either in the form of cash or of a credit card of some type. The trays are typically relatively shallow, long, and narrow. They are designed to accommodate the type of bill used by the particular business establishment. Such tray usually have a relatively shallow and flat center portion with a slightly raised outer periphery to prevent a bill, change, a credit card, or the like, from falling off the tray.

Unless the customer takes time to mentally add the various charges together, or unless the customer possesses a pocket calculator for making the arithmetic calculations, there is no verification of the total of the bill. Furthermore, if a customer prefers to provide a gratuity of a predetermined percentage of the bill, there is no way of calculating the desired amount easily without the aid of a calculator or without expending time to mentally make the necessary arithmetic calculation unless the bill is for a round number which lends itself to easy calculation, or unless the predetermined percentage is easily calculable. Otherwise, the customer simply makes an estimate of what such intended gratuity should be, based on a mental rounding off of the figures or the calculation therefor. Similarly, a waiter/waitress must also perform the arithmetic calculations required in adding all of the charges together. This is either done mentally or with the aid of an adding machine, if available. Alternatively, a waiter/waitress may provide their own calculator for making the arithmetic calculations, including taxes, if any.

SUMMARY OF THE INVENTION

The invention described and claimed herein comprises a tray which includes a calculator for enabling a customer of a business or commercial establishment to perform and to confirm arithmetic calculations.

Among the objects of the present invention are the following:

To provide new and useful tray apparatus;

To provide new and useful tray apparatus having a calculator;

To provide new and useful tray apparatus for business establishments;

To provide new andd useful apparatus for presenting a statement of charges to a customer of food and beverage establishments;

To provide new and useful calculator apparatus for making arithmetic calculations of a food and/or beverage bill;

To provide new and useful apparatus for holding a credit card on a tray; and

To provide new and useful tray and calculator apparatus for dividing a single bill among multiple customers.

DESCRIPTION OF THE PREFERRED EMBODIMENT

Figure 1:
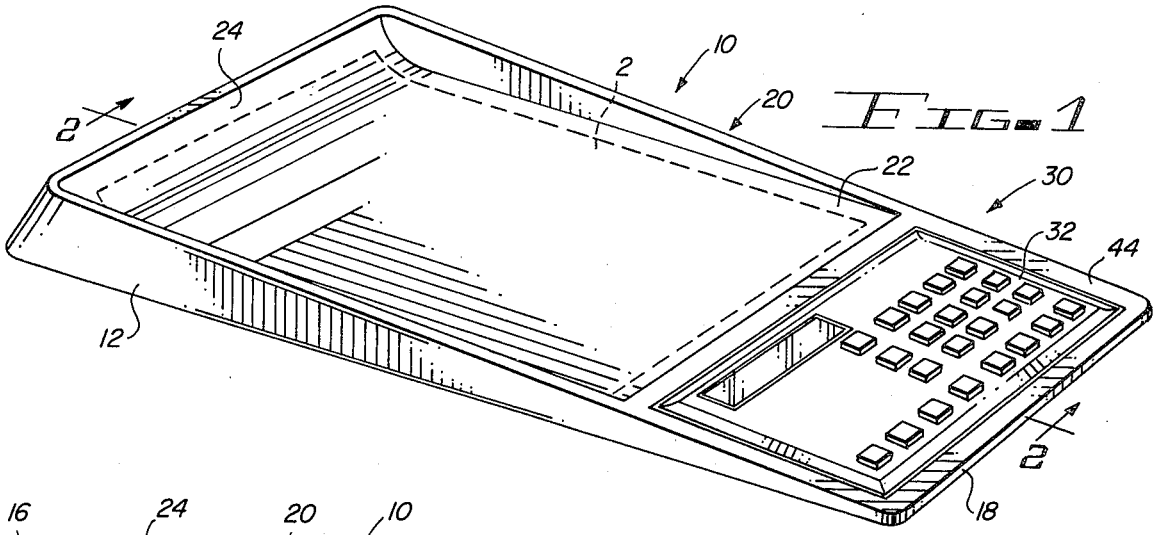
FIG. 1 comprises a perspective view of the apparatus of the present invention.
Figure 2:
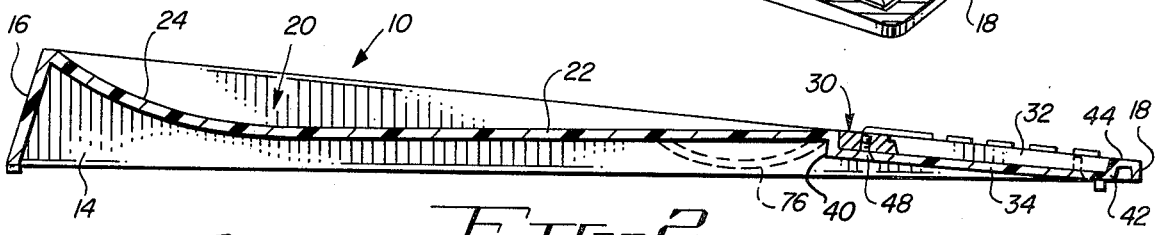
FIG. 2 is a view in partial section of the apparatus of FIG. 1 taken generally along line 2—2 of FIG. 1.

FIG. 1 is a perspective view of tray apparatus 10 of the present invention, and FIG. 2 is a view in partial section of the tray apparatus 10 of FIG. 1 taken generally along line 2—2 of FIG. 1. The following discussion will pertain to both FIGS. 1 and 2, and accordingly both Figures should be referred to in conjunction with the following descriptive material.

The tray apparatus 10 is of a generally rectangular configuration. It includes four walls, including a pair of side walls 12 and 14, a front wall 16, and a rear wall 18. The four walls are appropriately joined together to define the outer periphery of the tray apparatus 10. The front wall 16 is somewhat higher than the rear wall 18, and there is accordingly a slope from the upper portion of the front wall 16 downwardly to the rear wall 18.

The tray apparatus 10 includes a pair of depressions or recesses, including a relatively elongated depression 20, which comprises a front portion, and a calculator recess 30, which defines a rear portion. The front or forward depression 20 includes two separate portions, a generally flat downwardly and forwardly sloping rear portion 22, and an upwardly curved forward or front portion 24. The overall configuration of the depression 20 is generally rectangular between the sides 12 and 14, but generally concave from the front wall 16 rearwardly to the calculator recess 30. The tray apparatus 10 comprises a base element 11, including the four outer walls as discussed above, and the two depressions or recesses 20 and 30.

As best shown in FIG. 2, the flat rear portion 22 extends slightly downwardly from a wall 40, which divides or separates the calculator recess 30 from the depression 20, to where the curved front portion 24 blends with the flat, forwardly sloping rear portion 22. The curved front portion 24 extends from its juncture with the flat, sloping rear portion 22 upwardly to the upper portion of the front wall 16.

The purpose of the depression 20 is to receive a bill or invoice 2 for a customer of the user of the tray apparatus 10. The bill or invoice 2 is outlined in phantom in FIG. 1. The customer may in turn place currency, coins, a credit card, or the like in the depression 20 with the invoice for the payment thereof.

The calculator recess 30 is disposed rearwardly of the depression 20. It is a generally rectangular depression which receives a calculator 32. The recess 30 is defined by a generally flat bottom plate or portion 34, the rear portion of the side walls 12 and 14, the front or divider wall 40, and a rear wall 42. As best shown in FIG. 2, the rear wall 42 of the calculator recess 30 is spaced apart slightly from the rear wall 18 of the tray apparatus 10. A rim 44 extends about the recess 30 to define a generally flat, planar outer periphery of the recess. Forwardly of the calculator recess 30, the rim 44 blends into the sides 12 and 14.

Figure 3:
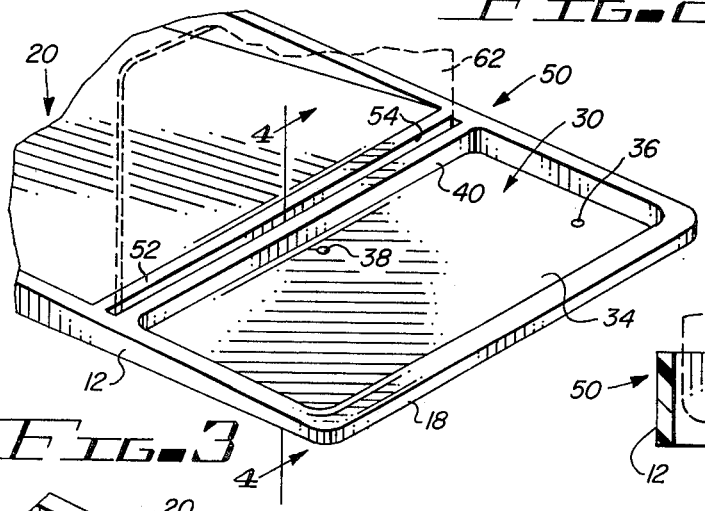
FIG. 3 is a fragmentary perspective view of an alternate embodiment of the apparatus of FIGS. 1 and 2.
Figure 4:
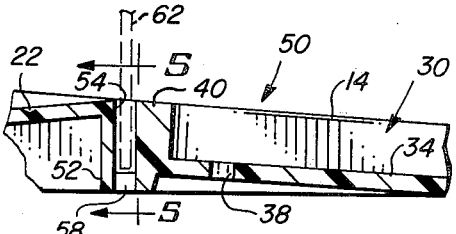
FIG. 4 is a sectional view of the apparatus of FIG. 3 taken generally along line 4—4 of FIG. 3.

As best shown in FIGS. 3 and 4, the calculator recess 30 includes two holes or apertures 36 and 38 which extend through the bottom 34. The purpose of the holes or apertures 36 and 38 is to receive a screw, such as the screw 48 shown in FIG. 2, to fasten or secure the calculator 32 within the calculator recess 30.

The purpose of the calculator 32 is to allow a customer to verify the arithmetic computations on the statement of charges or bill which the customer is presented with, as it is disposed within the depression 20. In addition, the calculator allows a customer or patron to calculate a gratuity, if the customer wishes to include such gratuity along with the payment of the bill or invoice. It is not untypical for a customer to base a gratuity on a percentage of the bill. Unless such percentage is one which is easily calculated, such as ten percent, the computation of the gratuity requires arithmetic calculations which are not easily accomplished without either a pencil and paper, or the like, or a calculator carried by the customer or patron. By providing a calculator 32 as an integral part of the tray in which a customer's invoice is presented, the customer has at his immediate disposal the necessary means to both verify the amount of the bill and the means to calculate any desired percentage of the bill as a gratuity, and further to add such gratuity to the original amount of the bill. Moreover, the efficiency of a waiter/waitress is increased by the ready availability of a calculator for preparing the bill, including tax computations, if required. Similarly, a calculator presented with a tray and a bill allows two or more customers to divide the bill into the proper amounts allocable to the various individuals.

While a pair of holes 36 and 38 are shown for securing the calculator 32 within the calculator recess 30, as by screws, and the like, alternate fasteners may also be used. For example, snaps or integral tabs, or the like, may be used to hold a calculator within the recess.

Figure 5:
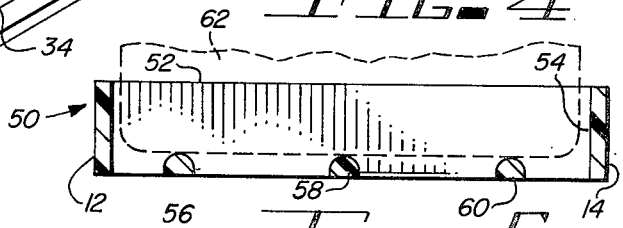
FIG. 5 is a sectional view of the apparatus of FIG. 4 taken generally along line 5—5 of FIG. 4.

FIGS. 3, 4, and 5 are illustrative of an alternate embodiment of the apparatus of FIGS. 1 and 2, with the alternate embodiment being represented by reference numeral 50. FIG. 4 is a sectional view of the apparatus 50 of FIG. 3 taken generally along line 4—4 of FIG. 3. FIG. 5 is a sectional view of the tray apparatus 50 taken generally along line 5—5 of FIG. 4. FIGS. 3, 4, and 5 should be referred to in the following discussion.

The tray apparatus 50 of FIGS. 3, 4, and 5 differs from the tray apparatus 10 of FIGS. 1 and 2 with the inclusion of a slot 54 between the depression 20 and the calculator recess 30. The slot 54 is defined by the front wall 40 of the calculator recess 30 and a rear wall 52 of the depression 20. The slot 54 extends between the sides 12 and 14. The slot 54 is adapted to receive a credit card, such as a credit card 62 shown in phantom in FIGS. 3, 4, and 5.

To prevent the credit card 62 from falling through the slot 54, three spacers or rungs 56, 58, and 60 extend across the slot 54 between the bottom or lower portion of the walls 40 and 52. The rungs 56, 58, and 60 are best shown in FIG. 5. A single rung 58 is shown in FIG. 4.

Since the tray apparatus of the present invention may be used in restaurants, bars, and other places where food and beverages of various types are served, it is not unlikely that food or drink may be spilled onto the tray apparatus of the present invention. Accordingly, to allow the tray apparatus to be cleaned in an efficient, and safe manner, and also to avoid problems of the accumulation of food or liquids, the slot 54 preferably extends vertically through the tray apparatus, with only the rungs 54, 58, and 60 extending across the bottom of the slot to prevent the credit card from dropping through the tray apparatus. If desired, only two rungs may be used, or the side walls 12 and 14 may include a generally horizontally extending flange within the slot 54, requiring only the use of a single rung or else eliminating the need for any rungs within the slot. However, it is preferable that the slot 54 not include a solid bottom which would allow food particles, liquid, or other residue to collect therein.

The width of the slot 54 need only be great enough to allow the inclusion of a credit card therein, and the thickness of the slot 54, or the spacing between the walls 40 and 54, need also only be sufficient to allow for the insertion of a credit card.

Figure 6:
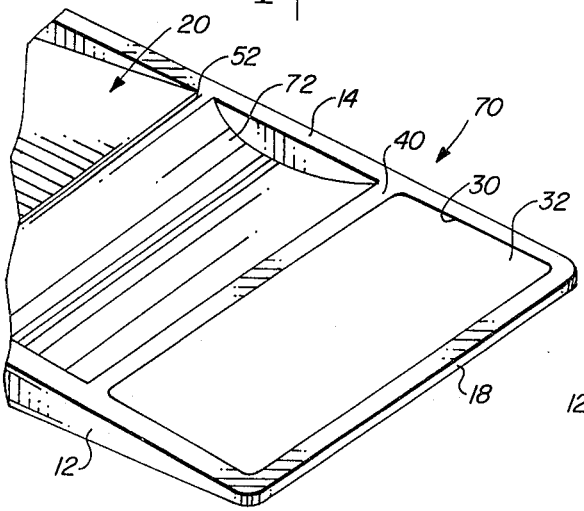
FIG. 6 is a fragmentary perspective view of another alternate embodiment of the apparatus of the present invention.

FIG. 6 is a perspective view of another alternate embodiment of the tray apparatus 10, with the embodiment of FIG. 6 being denoted by reference numeral 70. The primary difference between the tray apparatus 70 of FIG. 6 and the tray apparatus 10 of FIGS. 1 and 2 is the inclusion of a relatively or generally concave recess 72 between the calculator recess 30 and the depression 20. The purpose of the concave recess 72 is to receive and hold coins, tokens, pencils, or other items. The concave recess 72 extends between the sides 12 and 14 of the tray apparatus, and between the calculator recess 30 and the forward depression 20. The wall 52, which comprises the rear wall of the depression 20, shown in FIGS. 3, 4, and 5, is shown in FIG. 6 spaced apart from the front wall 40 of the calculator recess 30. Thus, the primary difference between the embodiment of the tray apparatus 50 of FIGS. 3, 4, and 5, and the tray apparatus 70 of FIG. 6 is the spacing apart of the wall 52 from the wall 40 and the inclusion of a relatively smooth, concave recess 72 between the walls 40 and 52.

To accommodate the recess 72, without shortening the length of the depression 20, the overall length of the tray apparatus 70 of FIG. 6 may be increased slightly from that shown in FIG. 10. However, it is obvious that the length of the recess 72, or the distance between the walls 40 and 52, need not be great because the size of the coins, pencils, tokens, etc., in current usage is relatively small.

If desired, the recess 72 may be a rear slight concave depression which comprises a continuation, rearwardly, of the depression 20. This may be best accomplished by simply terminating the generally upwardly extension of the relatively flat, sloping rear portion 22 from its lowermost point at the juncture of the rear portion 22 and the curved front portion 24 and at that point, wherever such convenient location may be, extending the most rearward portion downwardly and upwardly in a slight concavity. In this manner, overall length of the depression 20 need not be increased, and the overall effective length of the depression 20 is accordingly not incumbered, yet a separate depression may be formed for the specific purpose of receiving coins. Obviously, if desired, the concavity of the depression 20, itself, as best shown in FIGS. 1 and 2, is such as to readily allow the use of coins as well as currency, or cards, or any combination thereof. The alternate depression as part of recess 20 is shown in phantom in FIG. 2 and is noted by reference numeral 76.

A clip, now shown, may be included with the apparatus of the present invention to hold a card (or cards) for scoring purposes or to hold blank paper or even forms of various types. Such an alternate function may best be utilized with an embodiment such as shown in FIG. 6 or in phantom in FIG. 2 (depression 76). The tray apparatus is thus provided with alternate uses, such as keeping track of scores on a form provided for that purpose, computing values, prices, quantities, etc., at auctions and at stock or other types of brokerages, and the like.

Figure 7:
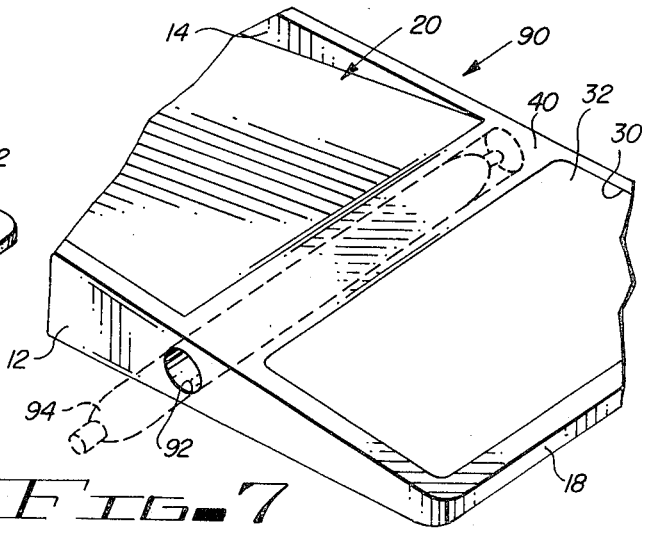
FIG. 7 is a fragmentary perspective view of another alternate embodiment of the apparatus of the present invention.

FIG. 7 is a fragmentary perspective view of still another alternate embodiment of the tray apparatus of the present invention. The tray apparatus of FIG. 7 is indicated by reference numeral 90. The tray apparatus 90 of FIG. 7 includes a pen/pencil receptacle 92 which extends between the sides 12 and 14 and between the calculator recess 30 and the depression 20. A pen 94 is shown in phantom in FIG. 7.

To accommodate the pencil/pen receptacle 92, the width of the wall 40 between the calculator recess 30 and the depression 20, is widened, as shown in FIG. 7, from the width of the wall 40 shown in FIGS. 1 and 2. Moreover, the wall 40 may extend for the full height of the walls 12 and 14 to allow the receptacle 92 to extend the full width of the tray apparatus 90. In such case, the receptacle 92 comprises or defines a bore which extend the full width of the tray apparatus 90.

An advertising message may be displayed on the top of the wall 40 in the tray apparatus 90. In addition, the bottom of the recess or depression 20, and the recess 72, and recess 76, may each or all include advertising messages, instructions, and the like, thus enhancing the practical value and broadening the applications of the tray apparatus of the present invention.

It will be appreciated and understood that the calculator is related to whatever writing element is employed with the tray for performing arithmetic calculations, and the like, with respect to the element. The term "element" includes an invoice, card, paper, or any other similar thing employed for containing or including information for which arithmetic calculations of some type may be needed or in some manner employed. For example, an invoice is an element which may contain one or more monetary entries which are added together to comprise a total bill. The calculator may be employed for adding the various entries to compute or to confirm the total, or the calculator may be used to divide the total among several individuals, or to sub-total some or all of the various entries on the invoice.

A score card may comprise an element when various entries comprising partial scores are entered thereon, and the calculator is then used to add the score components together. A tally card, or the like, may be included as the element on which entries may be made, as by bids at an auction, to keep track of bids, purchases, and the like. The calculator is used to make arithmetic computations of amounts paid, etc.

A depression, or a plurality of depressions, may be included on the tray for receiving any type of medium of exchange related to the element, or rather related to the sums thereon. For example, a credit card, for present purposes, may be considered as a medium of exchange, as well as currency, coins, checks, and the like.

For an invoice, used by a business or commercial establishment, a single depression which receives the invoice, or in which the invoice is disposed, may also receive the medium of exchange. Such apparatus is illustrated in FIGS. 1 and 2. FIGS. 3, 4, 5, and 6 include additional depressions for medium of exchange elements. A credit card depression 54 is shown in FIGS. 3, 4, and 5, while a different type of depression 72 is shown in FIG. 6. The addition of a second depression as part of a first, larger depression, is illustrated in phantom by reference numeral 76 in FIG. 2.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Tray apparatus, comprising, in combination:

base means, including a pair of side walls spaced apart from each other, a front wall secured to the side walls, a rear wall secured to the side walls, an elongated depression extending between the side walls and having a generally flat portion and having a curved portion secured to the front wall and adapted to receive an element having arithmetic entries thereon, and a first recess for receiving a calculator disposed between the elongated depression and the rear wall; and a calculator disposed in the first recess for performing arithmetic calculations in response to the arithmetic entries on the element in the depression.

2. The apparatus of claim 1 in which the base means includes a second recess disposed between the elongated depression and the first recess.

3. The tray apparatus of claim 2 in which the second recess comprises a slot for receiving a credit card.

4. The tray apparatus of claim 2 in which the second recess comprises a concave recess for receiving currency and coins.

5. The apparatus of claim 4 in which the second recess comprises a portion of the elongated depression.

6. The apparatus of claim 2 in which the base means further includes a receptacle for receiving a writing instrument.

* * * * *